United States Patent [19]

Degen

[11] Patent Number: 4,550,584

[45] Date of Patent: Nov. 5, 1985

[54] FIXED DUMMY BLOCKS

[75] Inventor: Max F. Degen, Weston, Canada

[73] Assignee: Indalex, Division of Indal Limited, Canada

[21] Appl. No.: 527,404

[22] Filed: Aug. 29, 1983

Related U.S. Application Data

[63] Continuation-in-part of Ser. No. 107,932, Dec. 28, 1979.

[51] Int. Cl.[4] ..... B21C 26/00

[52] U.S. Cl. ..... 72/273

[58] Field of Search ..... 72/254, 273, 273.5, 72/478

[56] References Cited

U.S. PATENT DOCUMENTS

| | | | |
|---|---|---|---|
| 2,925,176 | 2/1960 | Wyngaert | 72/478 |
| 3,303,684 | 2/1967 | Starr et al. | 72/273 |
| 3,385,091 | 5/1968 | Hess | 72/273 |
| 3,731,519 | 5/1973 | Mahns et al. | 72/273.5 |

FOREIGN PATENT DOCUMENTS

| | | | |
|---|---|---|---|
| 1110513 | 2/1956 | France | 72/273 |
| 53569 | 5/1978 | Japan | 72/273 |
| 2067944 | 8/1981 | United Kingdom | 72/273 |
| 664705 | 5/1979 | U.S.S.R. | 72/273.5 |
| 897361 | 1/1982 | U.S.S.R. | 72/273.5 |

*Primary Examiner*—Lowell A. Larson

*Attorney, Agent, or Firm*—Ivor M. Hughes

[57] ABSTRACT

An expandable fixed dummy block is provided for fixing on the end of a stem of an extrusion press. The dummy block has a longitudinally extending axis of symmetry and outer wall, a base having a central cavity symmetrical about the axis symmetry, and a mandrel symmetrical about the longitudinal axis for sitting in the cavity in the base and being free to rotate in the cavity. The cavity is defined by an endless side wall sloping radially inwardly from its mouth away from the outer wall to a bottom and the mandrel has a face and side wall sloping radially inwardly from the edge of the mandrel to a rear seat and having an outer edge bevelled so as not to extend beyond the inner radial dimensions of the mouth of the cavity. The angle of the side wall defining the cavity to the axis of symmetry is less than the angle of the side wall of the mandrel to the axis of symmetry.

26 Claims, 8 Drawing Figures

FIXED DUMMY BLOCKS

FIELD OF INVENTION

This is a continuation in part of application serial number 06/107932. This invention relates to fixed dummy blocks, used in extrusion presses.

BACKGROUND OF THE INVENTION

In the extrusion of metals (for example aluminum, brass, bronze, etc.) into length of a desired profile, very hot billets (in the order of about 500 degrees C. for aluminum) are loaded into the extrusion press for squeezing through the die;

For aligning, guiding and feeding the billet to, and through, the die the extrusion press comprises a hollow tubular container before the die, co-axial with the die and having an internal diameter greater (about 375/1000") than the outer diameter of the billet and a stem of lesser diameter than the diameter of the container tube co-axially aligned with the die and reciprocal from a position remote, to a position proximate, the die. Disposed intermediate the billet and stem is a dummy block loaded behind the billet when the billet is loaded and of substantially the same diameter as the central bore of the container (about 20/1000" clearance exists between the inner wall defining the bore of the container and dummy block) for engagement with the butt end of the billet for squeezing the billet through the die while substantially precluding back extrusion. The press includes a chute below the container adjacent the die so that when the stem is reciprocated away from the press, and the butt end of the billet is guillotined from the face of the die, the dummy block and butt end drop into the chute for manual removal at a remote station. The dummy block and butt end of the billet are then manually separated, the dummy block returned for reuse, and the butt end recovered for scrap. The above procedure is repeated for each billet, each repetition of the procedure requiring separate manipulation, and manhandling of each dummy block;

Attempts have been made to fix the dummy block permanently to the stem to save time, labour and back injuries. However, during the extrusion process a thin layer of billet metal builds up on the interior container wall defining the bore, decreasing the internal diameter of the container. Therefore, when the dummy block is retracted with the stem, the outer edge of the dummy block scrapes the thin layer of metal from the wall jamming the dummy block in the container and damaging the dummy block or container. The press must then be temporarily shut down for parts replacement or repair;

An attempt has been made in U.S. Pat. No. 3,303,684 to provide an expandable fixed dummy block of substantially the same diameter as the bore of the container for passage through the container when pushing a billet towards the die, but of reduced diameter when retracted;

The fixed dummy block disclosed is normally smaller than the container tube and presents a flat annular ring of metal at the periphery of the block surrounding a central curved dished portion, the flat annular ring for engagement with the butt end of the billet. As pressure is brought to bear against the butt end of the billet, the radius of curvature of the dished portion changes to flatten the dish and expand the effective diameter of the face of the fixed dummy block to substantially seal the container tube as the billet is squeezed through the die and preclude back extrusion past the dummy block to the stem. However, because of the fixed dummy block's dished configuration, as the billet is pushed forward to the fixed dummy block, billet metal collects in the dished portion reducing by an additional percentage, depending on the curvature of the dished portion, the total metal that may be extruded from each billet. When weights of metal in excess of millions of pounds are extruded each year, any additional percentage of waste or scrap metal increases costs substantially. Furthermore, no degree of control of the expansion of the diameter of the dummy block is provided resulting in uncontrolled expansion which in some instances could cause the fixed dummy block to seize against the inner wall of the tubular container;

It is therefore, an object of this invention to provide an expandable fixed dummy block which minimizes wastage of metal during the extrusion process and whose diameter changes can be controlled to control the expansion of the face of the dummy block;

Further and other objects of the invention will be realized by those skilled in the art from the following summary of the invention and detailed description of a preferred embodiment thereof.

SUMMARY OF THE INVENTION

According to one aspect of the invention, a fixed dummy block is provided for securing on the end of a stem mounted for reciprocal movement in an extrusion press, the fixed dummy block having:

(a) a longitudinal axis of symmetry;

(b) an outer wall;

(c) a circular base symmetrical about the longitudinal axis of symmetry and having a dished central portion or cavity, surrounded by an annular peripheral ring, preferably having a flat face, adjacent the mouth of the dished portion, the dished portion being defined by a bottom and endless side wall sloping radially inwardly in a direction away from the annular peripheral ring to the bottom;

(d) a mandrel symmetrical about the axis for seating in the dished portion, and having a face preferably being substantially flat, the mandrel having a side wall sloping radially inwardly from adjacent the edge of the mandrel, in a direction away from the face, to a rear seat, the angle of the sloped side wall of the dished portion to the longitudinal axis of symmetry of the dummy block being less than the angle of the side wall of the mandrel to the longitudinal axis of symmetry with the outer edge of the mandrel being bevelled so as not to extend radially beyond the inner radial dimensions of the mouth of the cavity, the thickness of the dummy block adjacent to the annular peripheral ring between the outer wall of the dummy block and the side wall defining the dished portion being sufficiently flexible to permit deflection thereof, the rear seat of the mandrel being spaced from the bottom of the dished portion when the mandrel is normally seated in the dished portion with the sloped walls engaging one another, but under substantial forces being exerted against the face of the mandrel, the rear seat of the mandrel is forced to seat against the bottom of the dished portion, causing the material of the base between the outer wall and side walls adjacent the peripheral ring to flex;

(e) means for securing the mandrel to the dished portion of the dummy block; and, (f) means for securing the dummy block to the stem;

In one embodiment, the angle of the side wall of the dished portion or cavity is about 45 degrees to the longitudinal axis of symmetry and the angle of the side wall of the mandrel is about 46 degrees to the longitudinal axis of symmetry a difference in angles of about 1 degree;

In another embodiment of the invention the angle of the side wall of the dished portion or cavity is about 29¾ degrees (29 degrees 45') to the longitudinal axis of symmetry and the angle of the side wall of the mandrel is about 30 degrees to the longitudinal axis of symmetry a difference of less than 1 degree;

According to another aspect of the invention, an expandable fixed dummy block is provided for an extrusion press, the dummy block having a longitudinally extending axis of symmetry, a base with a central cavity symmetrical about the longitudinal axis, the cavity defined by an endless sloping side wall, sloping towards the axis of symmetry, a mandrel symmetrical about the longitudinal axis for sitting in the cavity of the base and being freely rotatable in the base, and defined by sloping side walls tapering inwardly, the angle of the side wall defining the cavity to the axis of symmetry, being less than the angle of the side wall of the mandrel to the axis of symmetry.

As a result, an expandable fixed dummy block is provided on the end of the stem whose face radially expands under control (the distance between the rear seat of the mandrel and bottom of the dished portion controlling the expansion) to preclude back extrusion when forcing the billet metal through the extrusion die but which reduces in diameter when retracted from engagement with the butt end of the billet because the forces expanding the diameter of the dummy block are removed. Therefore, the deflected side wall restores to its initial position forcing the mandrel longitudinally forward. With this construction, a fixed dummy block can be fabricated and used, whose initial diameter is less than that of a conventional dummy block. Therefore, during retraction, it easily slips through the bore of the container.

The invention will now be illustrated with reference to the following drawings of embodiments of the invention and detailed descriptions thereof.

DETAILED DESCRIPTION OF PREFERRED EMBODIMENTS

Figure 1:
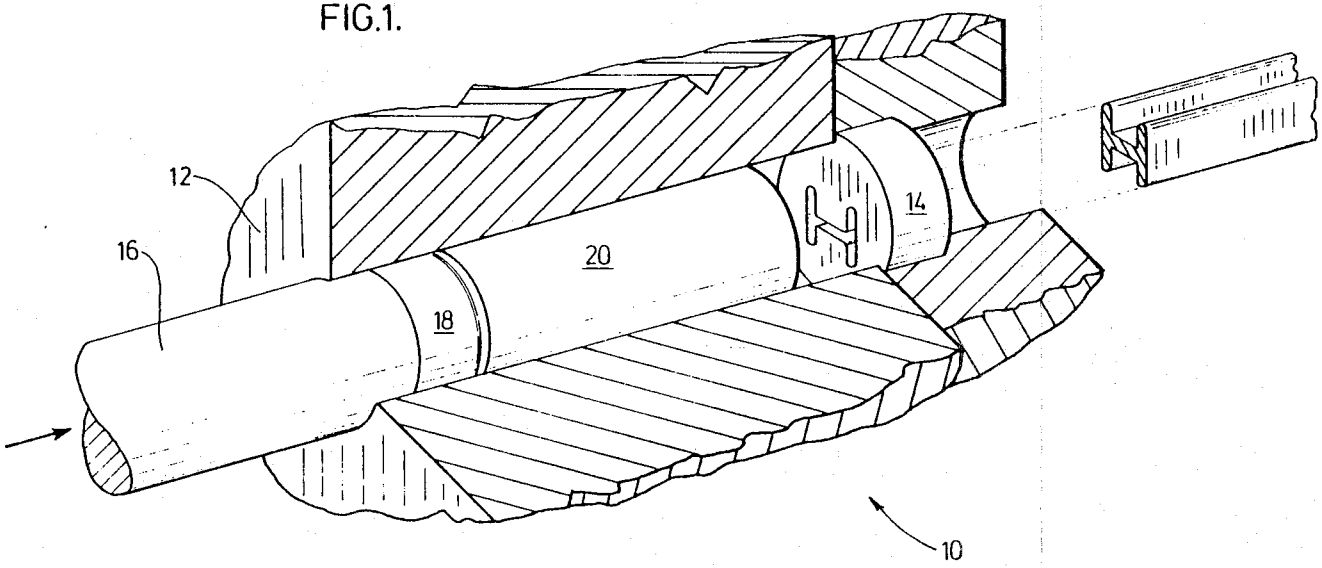
FIG. 1 is a perspective partially cut away view of part of an extrusion press incorporating the fixed dummy block according to an embodiment of the invention.

With reference to FIG. 1, there is shown a portion of extrusion press 10, having container tube 12, die 14, stem 16 co-axial with die 14 and reciprocal from a position remote, to a position proxamite, die 14, and fixed dummy block 18 for abutting billet 20 when stem 16 drives billet 20 through container tube 12 to die 14. Container tube 12 has an internal diameter of 7.375" (187 mm) and, centered co-axial stem 16 an outer diameter of 7.00" (178 mm) for riding freely through tube 12;

Fixed dummy block 18 (seen best in FIG. 3) comprises mandrel 21 having circular flat front face 22, surrounded by bevelled reinforcing edge 23, radially sloped side wall 24 sloping at an angle of 46 degrees to the longitudinal axis of symmetry of dummy block 18, to seat 26. Threaded annular shaft 28 symmetrical about the longitudinal axis extends rearwardly from mandrel 21 and includes locking pin receiving longitudinally extending slot 30. Mandrel 21 is constructed to be carried in dished cavity 32 of base 34. Base 34 has peripheral annular flat ring 36 (surrounding cavity 32) of 0.312" (7.9 mm) in thickness. Wall 38 slopes radially inwardly away from face 36 at an angle of 45 degrees to the longitudinal axis to bottom 40. Centered bore 42 extends rearwardly from bottom 40 and opens into cavity 44. Extending rearwardly therefrom is a cavity 46 of greater radius than cavity 44 for receiving pie inserts 48 carried in pie shaped slots 58 of connecting stud 50 for securing stem 16 to base 34. Bore 47 of reduced diameter extends rearwardly from cavity 46 and opens rearwardly from base 34;

Outer wall 35 defining the outer extent of base 34 is widest at 35*a* the cutting edge, adjacent peripheral ring 36 narrowing to portion 35*b;*

Figure 2:
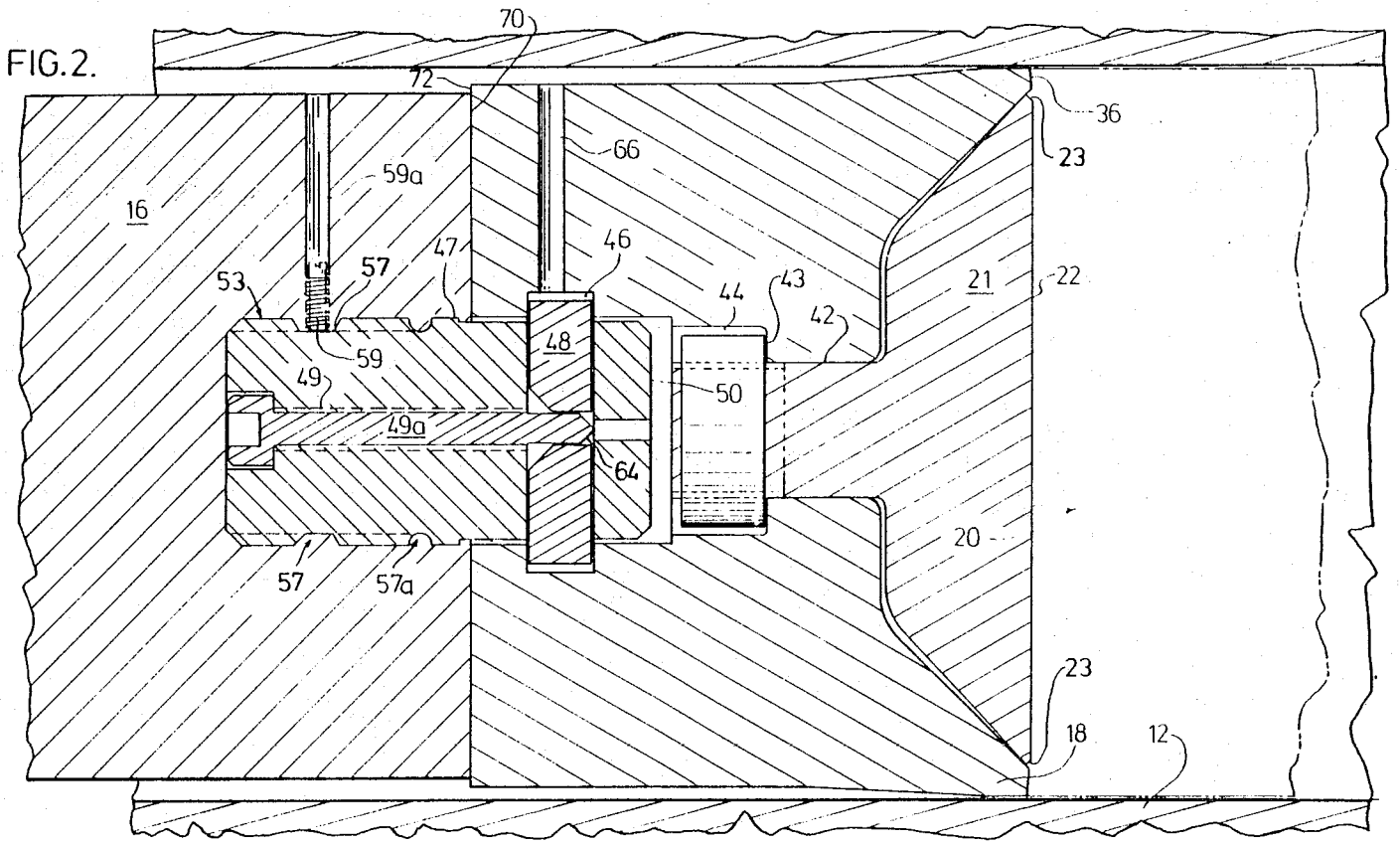
FIG. 2 is a cross-sectional close-up view taken along the lines 2—2 of FIG. 1.
Figure 4:
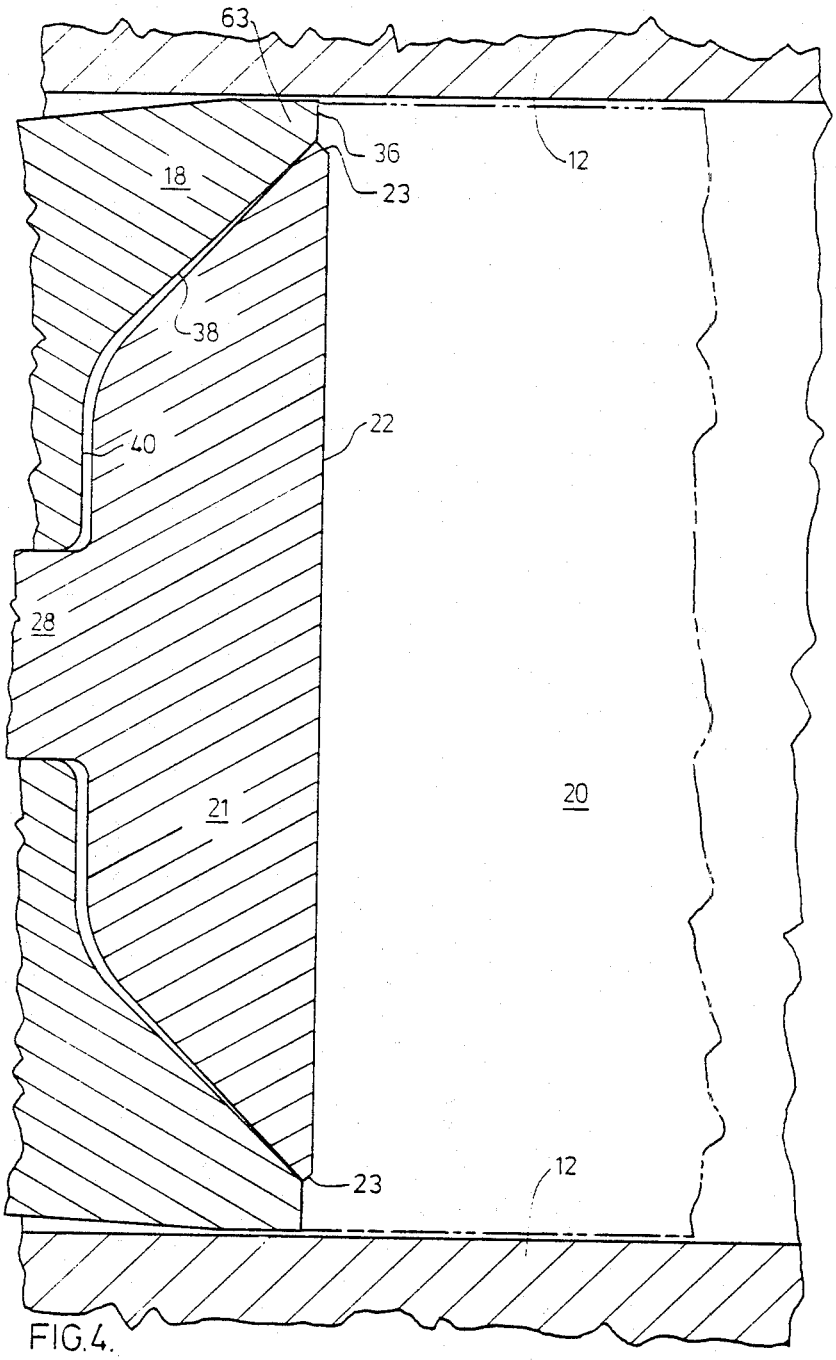
FIGS. 4 and 5 illustrate schematically the operation of part of the fixed dummy block shown in FIGS. 2 and 3.
Figure 5:
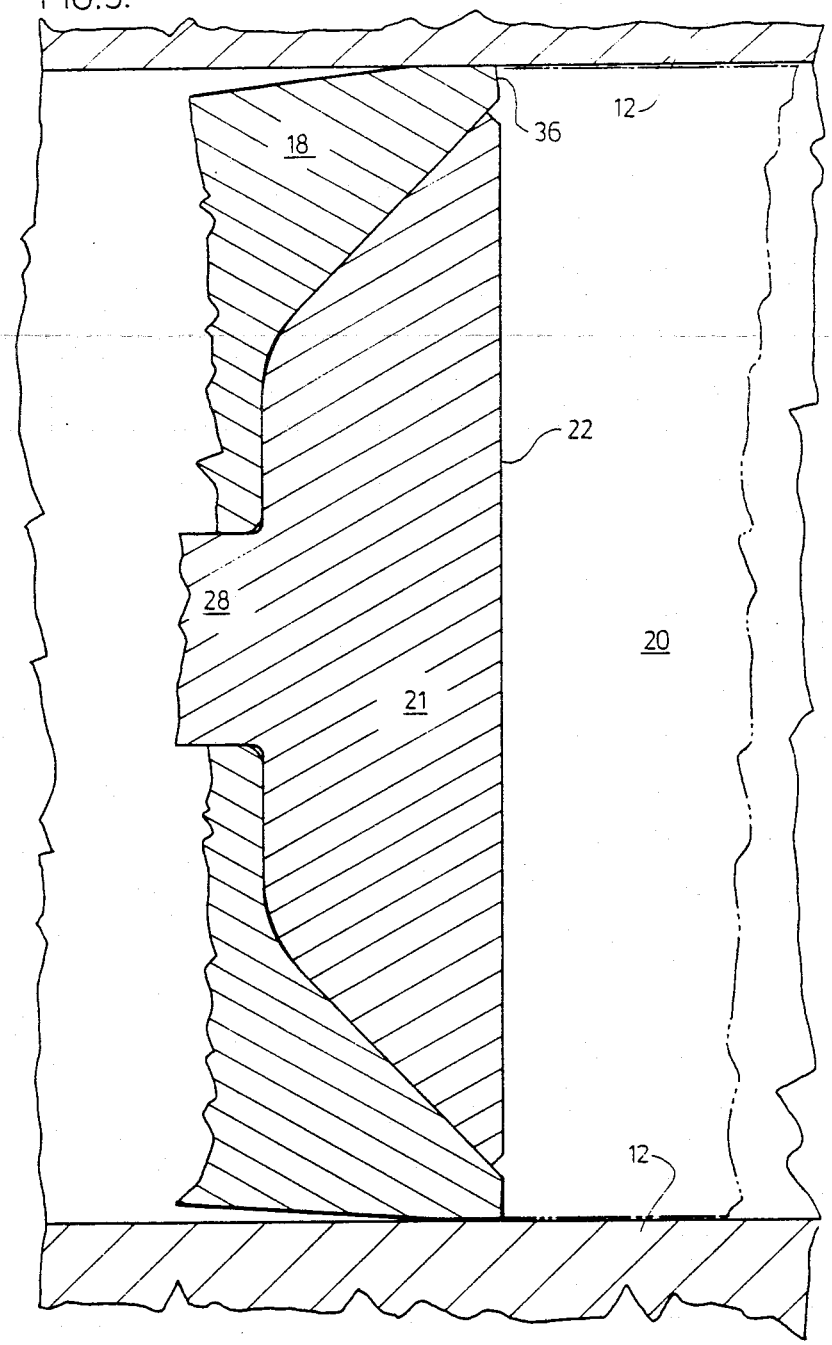

With reference to FIG. 2, mandrel 21 is secured in cavity 32 with shaft 28 extending through bore 42 into cavity 44 whereat threaded nut 52 is threaded onto shaft 28. Locking pin 54, pushed through aligned slot portions 56 (in nut 52) and 30 (in shaft 28) locks nut 52 to shaft 28 for holding mandrel 21 in cavity 32. Nut 52 only affects the movement of the mandrel when fixed dummy block 18 is withdrawn. In that instance, wall 43 between bore 42 and nut receiving cavity 44 engages nut 52;

Connector stud 50 secures stem 16 to fixed dummy block 18. For this purpose, end 53 is helically threaded for securing in helically threaded bore 55 of stem 16. For securing stud 50 therein to preclude rotation of stud 50 with respect to stem 16, groove 57 is provided to receive set screw 59. Undercut 57*a* defines the end of the helical threading. The other end of stud 50 contains three pie insert receiving cavities 58 spaced at intervals of 120 degrees to one another, and opening into bore 49, extending through stud 50. Bore 49 is threaded to receive screw 49*a* for expanding pie inserts into cavity 46 when stud 50 secures stem 16 to base 34. For this purpose, pie inserts 48 are shaped as sectors of circles and have front and rear faces 48*a* and 48*b*, arc wall 48*c* and apex 48*d*. Apex 48*d* is bevelled at 48*e* where it meets front face 48*a*. Therefore, the tapered tip 64 of screw 49*a* engages bevelled edges 48*e* as screw 49*a* was threaded into bore 49, forcing pie inserts radially outwardly into cavity 46 (and in particular portion 46*a*) locking stem 16 to dummy block 18. Three bores 66 positioned at 120 degrees to one another are provided for the purposes of, exhausting air, mounting the dummy block to the stem, and removing stud 50 from base 34;

With reference to FIG. 2, it will be observed that a clearance is provided in the connection between pie inserts 48, connector stud 50 and nut 52, and the inner walls defining the radial extent of cavities 44, 46 and 47, so that if container tube 12, stem 16 and die 14 are slightly misaligned, dummy block 18 is free to "float" to adjust for the misalignment and pass through tube 12 to push the billet to the die for extruding profile "H";

As can be seen in FIG. 2, because of the interfering action of the walls 24 and 38, mandrel 21 normally sits in cavity 32 with seat 26 slightly forward of bottom 40 (25/1000"-0.6 mm.). It will also be appreciated that when stud 50 connects stem 16 and base 34, stem 16 abuts base 34 so that when stem 16 is moved towards die 14, all longitudinal forces exerted by stem 16 are transmitted from front face 70 of stem 16 to back wall 72 and base 34 without being transmitted by connector 50. When dummy block 18 is pushed by stem 16 against the butt end of billet 20, the face of the mandrel 22 first engages the central part of rear butt end (See FIG. 4). At this point, the clearance (diameter v diameter) between the internal wall of container tube 12 and dummy block 18 is about 75/1000"-1.9 mm. As the pressure exerted by stem 16 on dummy block 18 increases, base 34 exerts pressure on mandrel 21 in turn increasing the pressure of the bllet on die 14. As a result, wall 38 starts to ride up wall 24. As it so moves, wall material 63 between outer wall 35*a* and inner wall 38 adjacent peripheral ring 36 flexes distorting the angle of face 36 increasing the diameter of dummy block 18. As wall 38 continues up wall 24, mandrel 21, seats on bottom 40 (See FIG. 5) thereby reducing the clearance between outer wall 18A of dummy block adjacent peripheral ring 36 and inner wall of container tube 12 from 75/1000"-1.9 mm. to 20/1000"-about 0.5 mm. Because of the pressure, the billet metal flows to conform to the frontal configuration of the mandrel 21 and peripheral ring 36. When stem 16 is retracted, dummy block 18 restores to the configuration shown in FIG. 4. Because the clearance between seat 26 and bottom 40 can be varied when originally manufactured, the amount of expansion of the dummy block can be controlled;

Therefore because the face of the dummy block expands under control when pressure is applied by stem 16 to the dummy block 34, the dummy block cannot be overexpanded and thus will not seize when passing through the container tube 12 when pushing the billet through the die 14;

For mounting dummy block 18 to stem 16, mandrel 21 is first secured in base 34 by nut 52 and pin 54. Next pie shaped inserts 48 are inserted into pie receiving cavities 58 of connector stud 50 and stud 50 is then inserted through bore 47 to position inserts 48 in cavity 46. Screw 49*a* is threaded into bore 49 engaging bevelled edge 48*a* pushing inserts 48 radially outwardly into the outer reaches 46*a* of cavity 46. Stud 50 is therefore free to rotate with respect to base 34.

For securing stud 50 to stem 16, three hardened metal rods (not shown) are inserted into the three bores 66 opening through the outer surface of stud 50. The dummy block 18-stud 50 combination is then threaded onto stem 16. Because rods (not shown) must engage protruding pie inserts 48, as dummy block 18 is rotated, stud 50 temporarily is caused to rotate with dummy block 18, until faces 70 and 72 meet. At this point, threaded bore 59*a* of stem 16 overlies groove 57. Set screw 202 is then threaded into bore 59*a* and locked into groove 57. The rods are then removed from bores 66. To remove dummy block 18 from stem 16, the above steps are reversed.

Figure 6:
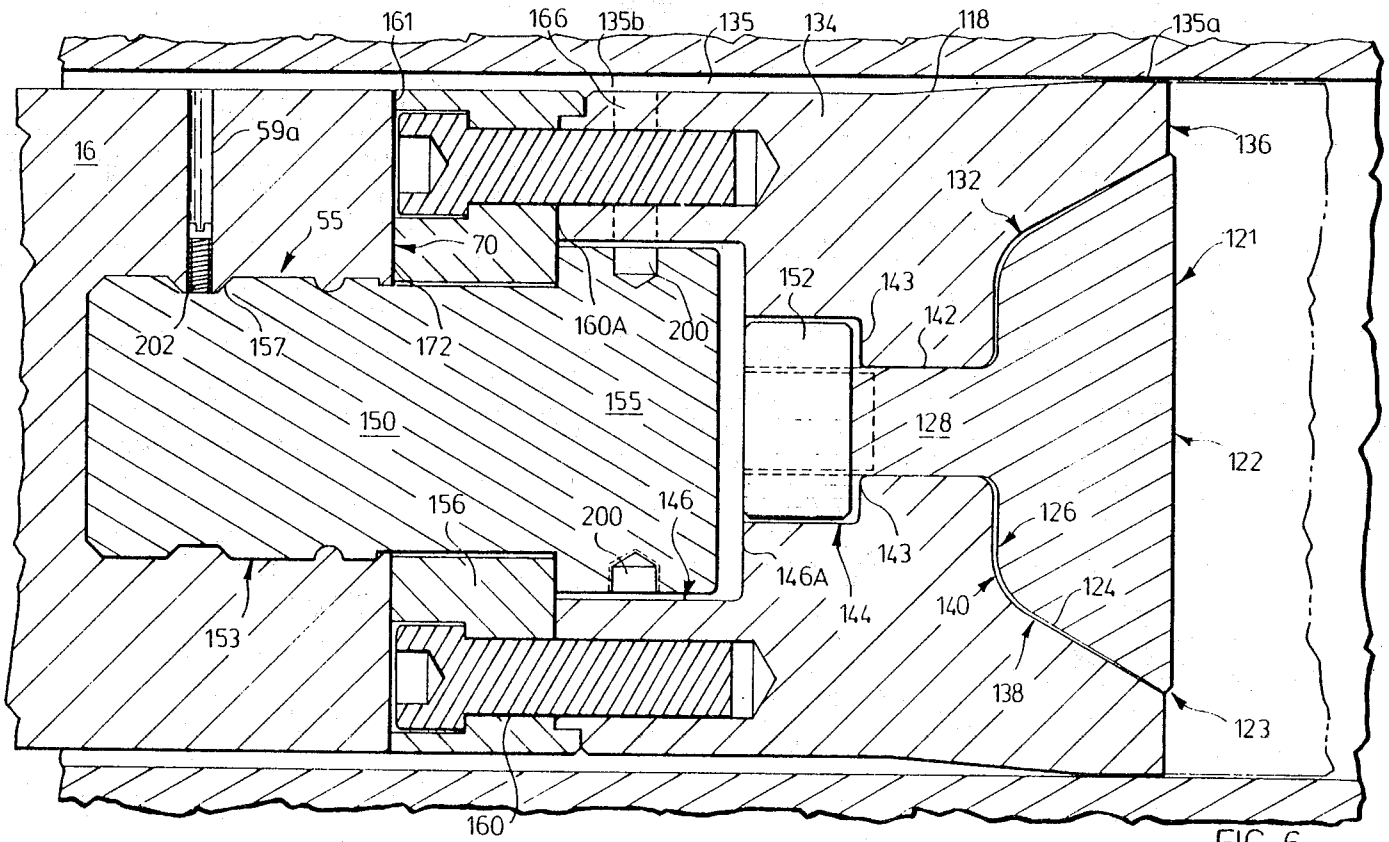
FIG. 6 is a cross-sectional close-up view of a fixed dummy block according to a preferred embodiment of the invention.
Figure 7:
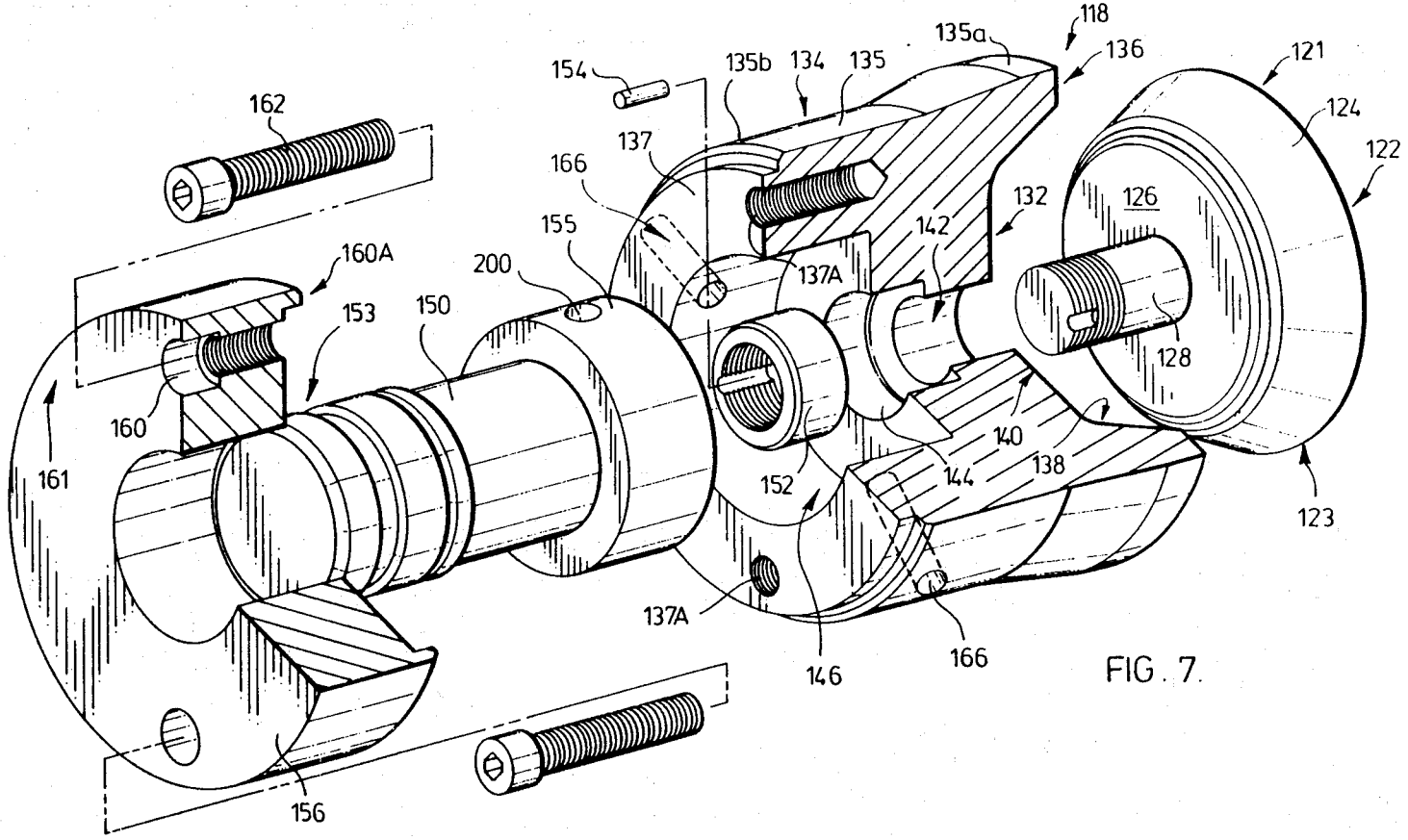
FIG. 7 is a perspective exploded view of part of the structure shown in FIG. 6.

With reference to FIGS. 6 and 7, fixed dummy block 118 comprises mandrel 121 having flat circular front face 122, surrounded by bevelled reinforced edge 123, radially sloped side wall 124 sloping at an angle of 30 degrees to the longitudinal axis of symmetry of dummy block 118 to seat 126. Threaded annular shaft 128 symmetrical about the longitudinal axis extends rearwardly from mandrel 121.

Mandrel 121 is constructed to be carried in dished cavity 132 at base 134. Base 134 has peripheral annular flat ring 136 (surrounding cavity 132) of 0.700" (17.8 mm.) in thickness, thicker than ring 36. Wall 138 slopes radially inwardly from face ring 136 at an angle of 29 degrees 45' to the longitudinal axis of symmetry of base 134 to bottom 140. Centered bore 142 extends rearwardly from bottom 140 and opens into cavity 144. Extending rearwardly therefrom is cavity 146 of greater radius than cavity 144. Shaft 128 extends into cavity 144 when wall 124 of mandrel 121 seats against wall 138 of base 134 and is locked therein by locking nut 152 in cavity 144. Nut 152, is secured to stem 128 employing pin 154 in the same manner as nut 52 was secured to stem 28 and only affects the movement of mandrel 121 when fixed dummy block 118 is withdrawn. In that instance, wall 143 between bore 142 and cavity 144 engages nut 152 causing mandrel 121 to be withdrawn with dummy block 118.

Outer wall 135 defining the outer extent of base 134 is widest at 135*a* the cutting edge adjacent peripheral ring 136 narrowing to portion 135*b*.

Connector stud 150 secures stem 16 to fixed dummy block 118. For this purpose, end 153 is helically threaded and secured in helically threaded bore 55 of stem 16 in the same manner as stud 50 was secured to stem 16. The other end of stud 150 bears radially enlarged head 155 greater in size than cavity 144 but of lesser radial dimensions than cavity 146 for sitting in cavity 146. Cavity 146 is longer (with respect to its longitudinal axis of the cavity) than head 155 of stud 150. Threaded blind bores 137A are provided through annular ring 137 at the rear end of base 134. Annular ring 156 is provided to be secured to the rear end of base 134 when the head 155 of stud 150 is carried in cavity 146. To this end bores 160 through ring 156 are aligned with threaded blind hole bores 137A and threaded studs 162 secure ring 156 to base 134 with stud 150 projecting therefrom.

For securing stud 150 to stem 16, as with the securing of stud 50 to stem 16, three hardened metal rods (not shown) are inserted into the three bores 166 (only two of which are shown) opening through the outer surface of stud 150. The dummy block 118-stud 150 combination is then threaded onto stem 16. Because rods (not shown) must engage three bore holes, two of which are shown in FIG. 6 as 200, as dummy block 118 is rotated, stud 150 is temporarily caused to rotate with dummy block 118 until faces 70 and 172 meet. At this threaded point bore 59*a* of stem 16 overlies groove 157. Set screw 202 is then threaded into threaded bore 59*a* and locked into groove 157. The rods are then removed from bores 166. To remove dummy block 118 from stem 16, the above steps are reversed.

Figure 3:
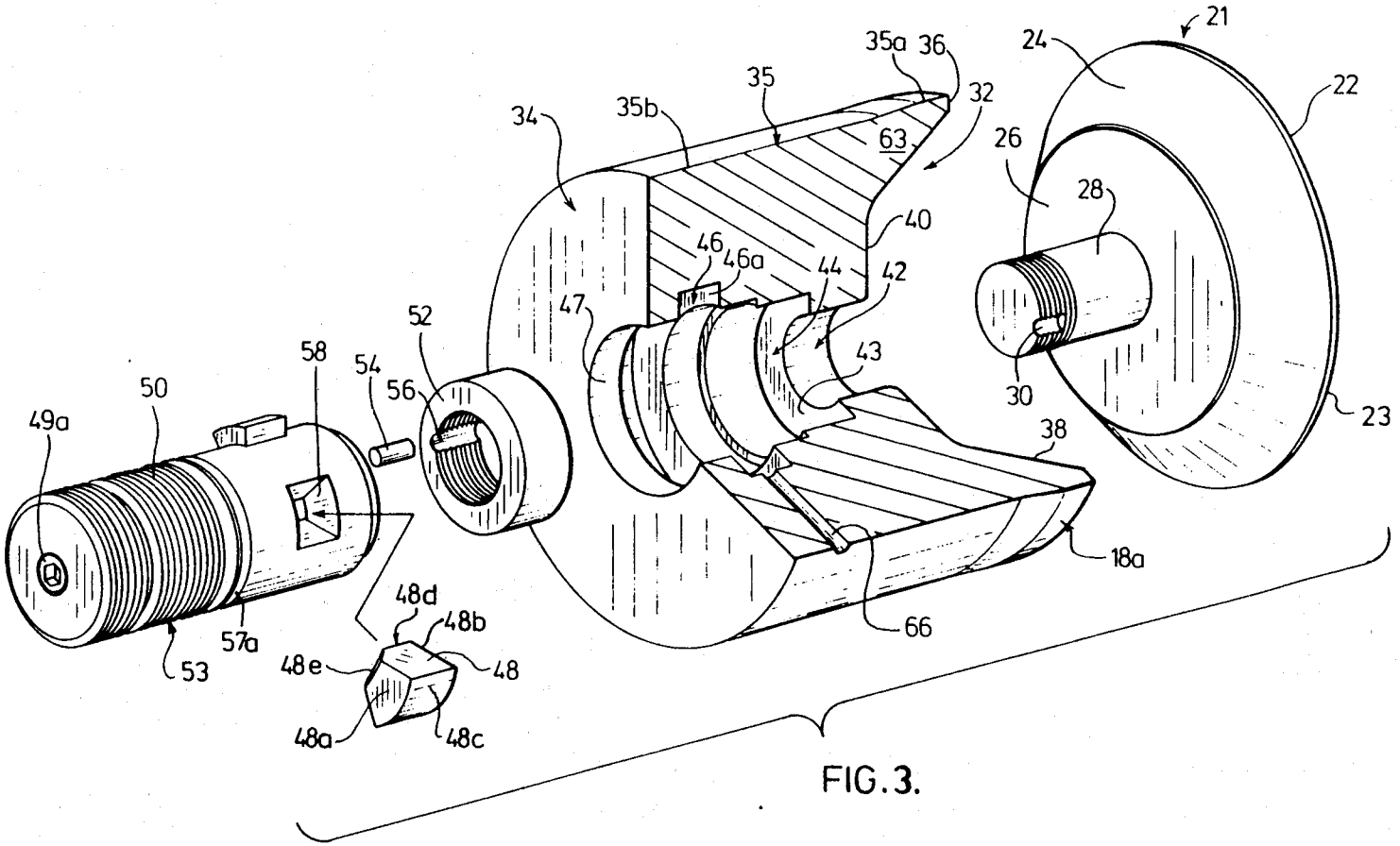
FIG. 3 is a perspective exploded view of part of the structure shown in FIG. 2.

As in the embodiments shown in FIGS. 2 and 3 when the leading end of stem 16 abuts the rear end 161 of ring 156, the leading end of enlarged head 155 does not engage the forward wall 146A of cavity 146. However, when stem 16 is retracted, the head 155 engages the leading end 160A of ring 156 causing fixed dummy block to be retracted.

Figure 8:
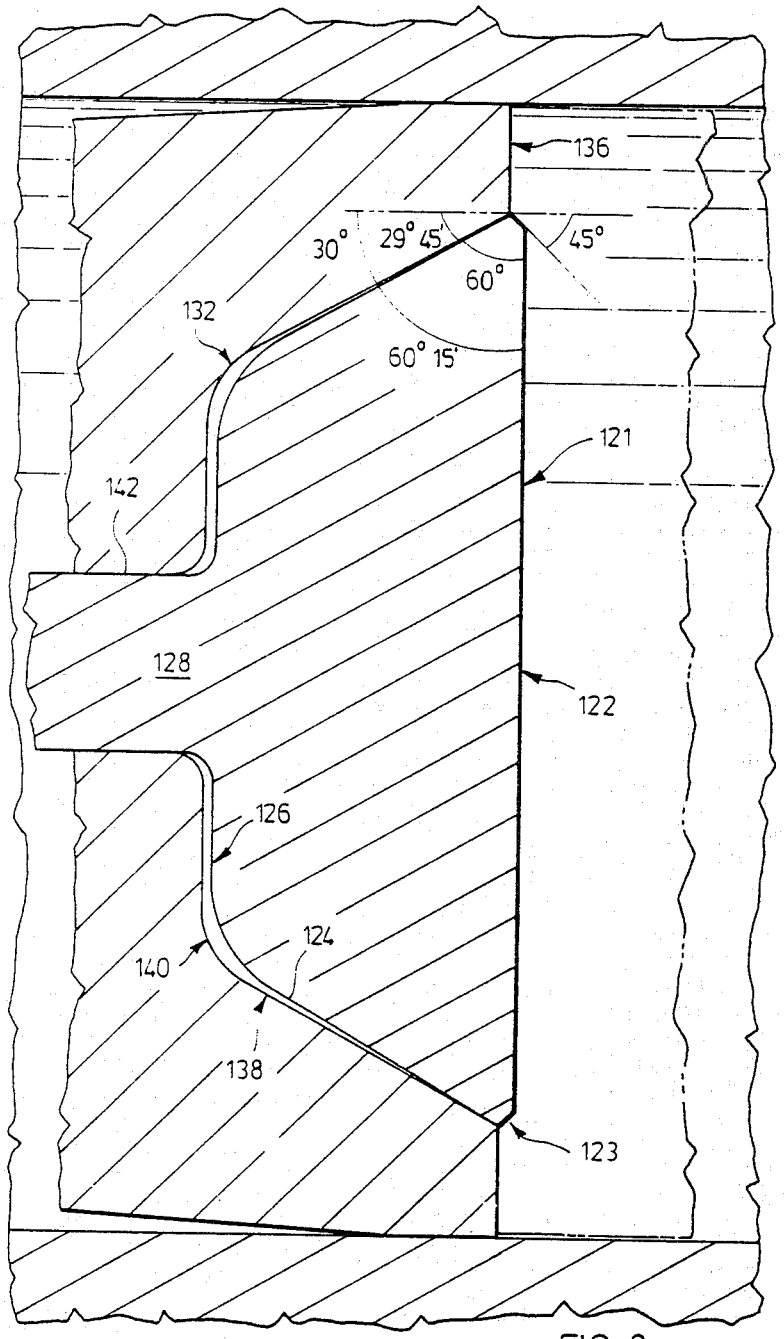
FIG. 8 is a close-up view of part of the structure shown in FIG. 6.

As can be seen in FIG. 6, because of the interfering action of walls 124 and 138, mandrel 121 sits in cavity 132 with seat 126 slightly forward of bottom 140 (0.025"-0.6 mm.). It will also be appreciated that when stud 150 connects stem 16 and base 134, stem 16 abuts base 134 so that when stem 16 is advanced towards die 14, all longitudinal forces exerted by stem are transmitted from the front face 70 of stem 16 to back wall 161 of annular ring 160 without being transmitted by connector 150. When dummy block 118 is pushed by stem 16 against the butt end of billet 20, the face of the mandrel 122 first engages the central part of rear butt end (See FIG. 8). At this point, the clearance (diameter v diameter) between the internal wall of container tube 12 and dummy block is about 75/1000" (-1.9 mm.). As the pressure exerted by stem 16 on dummy block 18 increases, base 134 exerts pressure of the billet on die 14. As a result, wall 138 starts to ride up wall 124. As it so moved, wall material between outer wall 135*a* and inner wall 138 adjacent peripheral ring 136 flexes increasing the diameter of dummy block 118. As wall 138 continues up wall 124, mandrel 121 seats on bottom 140 thereby reducing the clearance between the outer wall of dummy block 118 adjacent peripheral ring 136 and the inner wall of container tube 12 from 75/1000" (1.9 mm.) to 20/1000" (about 0.5 mm.). Because of the pressure, the billet metal flows to conform to the frontal configuration of the mandrel 121 and peripheral ring 136. When stem 16 is retracted, dummy block 118 restores to the configuration shown in FIG. 8. Once again, because the clearance between seat 126 and bottom 140 can be varied when originally manufactured, the amount of expansion of the dummy block can be controlled. Because the face of the dummy block expands under control when pressure is applied by stem 16 to the dummy block 134, the dummy block cannot be overexpanded and thus will not seize when passing through the container tube 12 when pushing the billet through the die 14.

As many changes can be made to the preferred embodiments without departing from the scope of the invention; it is intended that all matter contained herein shall be interpreted as illustrative of the invention and not in a limiting sense.

The embodiments of the invention in which an exclusive property or privilege is claimed are as follows:

1. In an expandable fixed dummy block for fixing on the end of a stem of an extrusion press, the dummy block having a longitudinally extending axis of symmetry and outer wall, comprisng a base having a central cavity symmetrical about the axis symmetry, and a mandrel symmetrical about the longitudinal axis for sitting in the cavity in the base and mounted to rotate freely therein, the cavity defined by an endless side wall sloping radially inwardly away from its mouth from the outer wall to a bottom and the mandrel having a face and side wall sloping radially inwardly from the edge of the mandrel to a rear seat and having an outer edge bevelled so as not to extend radially beyond the inner radial dimensions of the mouth of the cavity, the angle of the side wall defining the cavity to the axis of symmetry being less than the angle of the side wall of the mandrel to the axis of symmetry.

2. In the expandable dummy block of claim 1 in which the endless side wall of the cavity is angled at an angle of about 45° to the longitudinal axis of symmetry and the side wall of the mandrel is angled at an angle of about 46° to the axis of symmetry.

3. In an expandable fixed dummy block of claim 1 in which the endless side wall is angled at an angle of about 29¾° to the longitudinal axis of symmetry and the side wall of the mandrel is angled at about 30° to the longitudinal axis of symmetry.

4. A fixed dummy block for securing on the end of a stem mounted for reciprocal movement in an extrusion press, the fixed dummy block having:

(a) a longitudinal axis of symmetry;

(b) an outer wall;

(c) a circular base symmetrical about the longitudinal axis of symmetry, having a dished central portion or cavity having a mouth and surrounded by an annular peripheral ring portion adjacent the mouth of the dished portion, the dished portion being defined by a bottom and an angled side wall sloping radially inwardly in a direction away from annular peripheral ring portion to the bottom;

(d) a mandrel symmetrical about the longitudinal axis for seating in the dished portion and mounted to rotate freely therein, the mandrel having a face, a side wall sloping radially inwardly adjacent the edges of the mandrel in a direction away from the face to a rear seat, and having an outer edge bevelled so as not to extend radially beyond the inner radial dimension of the mouth of the cavity, the angle of the sloped side wall of the dished portion to the longitudinal axis of symmetry of the dummy block being less than the angle of the side wall of the mandrel to the longitudinal axis of symmetry, the thickness of the dummy block adjacent the annular peripheral ring portion between the outer wall of the dummy block and side wall defining the dished portion being sufficiently flexible to permit deflection thereof, the rear seat of the mandrel being spaced from the bottom of the dished portion when the mandrel is normally seated in the dished portion with the sloped walls engaging one another but under substantial forces exerted against the face of the mandrel, the rear seat of the mandrel is forced to seat against the bottom of the dished portion, causing the material between the outer wall and side wall of the dished portion adjacent the peripheral ring, to flex;

(e) means for securing the mandrel to the dished portion of the dummy block; and, (f) means for securing the dummy block to the stem.

5. The fixed dummy block of claim 4, wherein the face of the mandrel and peripheral annular ring are both substantially flat.

6. The fixed dummy block of claim 4 or 5, wherein the angle of the side wall of the dished cavity portion is about 45° to the longitudinal axis and the angle of the side wall of the mandrel is about 46° to the longitudinal axis.

7. The fixed dummy block of claim 4 or 5, wherein the angle of the side wall of the dished cavity portion is about 29¾° to the longitudinal axis and the angle of the side wall of the mandrel is about 30° to the longitudinal axis.

8. An extrusion press comprising a die, a container tube, a stem reciprocal from a position remote the die to a position proximate the die through the container tube and a fixed dummy block, fixed to the end of the stem, the dummy block having a longitudinal axis of symmetry and outer wall and comprising a base having a central cavity symmetrical about the longitudinal axis of symmetry, a mandrel symmetrical about the longitudinal axis of symmetry for sitting in the cavity in the base and mounted to rotate freely therein, the cavity defined by an endless side wall sloping radially inwardly from its mouth away from the outer wall to a bottom and the mandrel having a face and side wall sloping radially inwardly from the edge of the mandrel to a rear seat and having an outer edge bevelled so as not to extend radially beyond the inner radial dimensions of the mouth of the cavity, the angle of the side wall defining the cavity to the axis of symmetry being less than the angle of the side wall of the mandrel to the axis of symmetry.

9. An extrusion press, comprising a die, a container tube, a stem reciprocal from a position remote the die to a position proximate the die through the container tube and a fixed dummy block, fixed to the end of the stem, the dummy block having:

(a) a longitudinal axis of symmetry;

(b) an outer wall;

(c) a circular base symmetrical about the longitudinal axix of symmetry, having a dished central portion or cavity, and surrounded by an annular peripheral ring portion adjacent the mouth of the dished portion, the dished portion being defined by a bottom and an angled side wall sloping radially inwardly from its mouth in a direction away from annular peripheral ring portion to the bottom;

(d) a mandrel symmetrical about the longitudinal axis for seating in the dished portion and mounted to rotate freely therein, the mandrel having a face, a side wall sloping radially inwardly adjacent the edges of the mandrel in a direction away from the face to a rear seat and having an outer edge bevelled so as not to extend to a rear seat and having an outer edge bevelled so as not to extend radially beyond the inner radial dimensions of the mouth of the cavity, the angle of the sloped side wall of the dished portion to the longitudinal axis of symmetry of the dummy block being less than the angle of the side wall of the mandrel to the longitudinal axis of symmetry, the thickness of the dummy block adjacent the annular peripheral ring portion between the outer wall of the dummy block and side wall defining the dished portion being sufficiently flexible to permit deflection thereof, the rear seat of the mandrel being spaced from the bottom of the dished portion when the mandrel is normally seated in the dished portion with the sloped walls engaging one another but under substantial forces exerted against the face of the mandrel the rear seat of the mandrel is forced to seat against the bottom of the dished portion, causing the material between the outer wall and side wall of the dished portion adjacent the peripheral ring, to flex;

(e) means for securing the mandrel to the dished portion of the dummy block; and, (f) means for securing the dummy block to the stem.

10. The extrusion press of claim 9, wherein the face of the mandrel and, peripheral annular ring are both substantially flat.

11. The extrusion press of claim 8, 9 or 10, wherein the angle of the side wall of the dished cavity portion is about 45° and the angle of the side wall of the mandrel is about 46°.

12. The extrusion press of claim 8, 9 or 10, wherein the angle of the side wall of the dished portion is about $29\frac{3}{4}°$ to the axis of symmetry and the angle of the side wall of the mandrel to the axis of symmetry is about 30°.

13. The extrusion press of claim 8, 9 or 10, wherein the means for securing the dummy block to the stem permits the dummy block to shift its longitudinal axis out of co-axial alignment with the axis of the stem to permit automatic adjustment of the dummy block to float to minimize the effect of errors in alignment of the stem, container tube and die of the extrusion press.

14. The extrusion press of claim 8, 9 or 10, wherein the stem abuts the back of the base of the dummy block when the dummy block is secured thereto.

15. The extrusion press of claim 8, 9 or 10, wherein a container stud secures the stem to the base of the dummy block, the container stud being helically threaded at one end for securing into a helically threaded bore of the stem, the stud having a helically threaded longitudinally extending central bore for receiving a helically threaded screw with a tapered tip and insert receiving slots extending radially inwardly from the surface of the stud at equally spaced intervals to open into the bore, a plurality of inserts for positioning in the slots, but which are pushed radially outwardly from the slots when the screw is threaded into the bore, a central bore extending into the base, and a tapered tip screw for threading into the central bore in the stem.

16. The extrusion press of claim 8, 9 or 10, wherein a connector stud secures the stem to the base of the dummy block, the connector stud having a shaft having means on one end to secure it to the stem and a radially enlarged head at the other end for locking in a cavity in the rear of the base with end of the enlarged head proximate the shaft for abutting the rear wall defining the rear of the cavity when the dummy block is to be retracted but with the front face of the enlarged head always spaced from the front wall defining the cavity, and wherein the stem abuts the back of the base of the dummy block when the dummy block is secured thereto.

17. In the expandable fixed dummy block of claim 1, wherein the difference between the angle at which the endless sidewall of the cavity is angled to the longitudinal axis of symmetry and the angle at which the side wall of the mandrel is angled to the axis of symmetry is about 1 degree.

18. In the expandable fixed dummy block of claim 1, wherein the difference between the angle at which the endless side wall of the cavity is angled to the longitudinal axis of symmetry and the angle at which the side wall of the mandrel is angled to the axis of symmetry is less than 1 degree.

19. The fixed dummy block of claim 4, wherein the difference between the angle at which the endless sidewall of the cavity is angled to the longitudinal axis of symmetry and the angle at which the side wall of the mandrel is angled to the axis of symmetry is about 1 degree.

20. The fixed dummy block of claim 5, wherein the difference between the angle at which the endless sidewall of the cavity is angled to the longitudinal axis of symmetry and the angle at which the side wall of the mandrel is angled to the axis of symmetry is about 1 degree.

21. The fixed dummy block of claim 4, wherein the difference between the angle at which the endless side wall of the cavity is angled to the longitudinal axis of symmetry and the angle at which the side wall of the mandrel is angled to the axis of symmetry is less than 1 degree.

22. The fixed dummy block of claim 5, wherein the difference between the angle at which the endless side wall of the cavity is angled to the longitudinal axis of symmetry and the angle at which the side wall of the mandrel is angled to the axis of symmetry is less than 1 degree.

23. The extrusion press of claim 9, wherein the difference between the angle at which the endless sidewall of the cavity is angled to the longitudinal axis of symmetry and the angle at which the side wall of the mandrel is angled to the axis of symmetry is about 1 degree.

24. The extrusion press of claim 10, wherein the difference between the angle at which the endless side wall of the cavity is angled to the longitudinal axis of symmetry and the angle at which the side wall of the mandrel is angled to the axis of symmetry is about 1 degree.

25. The extrusion press of claim 9, wherein the difference between the angle at which the endless side wall of the cavity is angled to the longitudinal axis of symmetry and the angle at which the side wall of the mandrel is angled to the axis of symmetry is less than 1 degree.

26. The extrusion press of claim 10, wherein the difference between the angle at which the endless side wall of the cavity is angled to the longitudinal axis of symmetry and the angle at which the side wall of the mandrel is angled to the axis of symmetry is less than 1 degree.

* * * * *

UNITED STATES PATENT AND TRADEMARK OFFICE

CERTIFICATE OF CORRECTION

PATENT NO. : 4,550,584

DATED : November 5, 1985

INVENTOR(S) : Max F. Degen

It is certified that error appears in the above-identified patent and that said Letters Patent is hereby corrected as shown below:

In the Claims, at column 9, line 25 at the beginning of the line before 'of', "axix" should be replaced with --axis--.

Signed and Sealed this

Twenty-fourth Day of January, 1989

*Attest:*

DONALD J. QUIGG

*Attesting Officer*

*Commissioner of Patents and Trademarks*